US008235250B2

(12) United States Patent
Zhang

(10) Patent No.: US 8,235,250 B2
(45) Date of Patent: Aug. 7, 2012

(54) DISPENSER WITH TWO FLEXIBLE TUBES

(75) Inventor: Jun Zhang, Sijhih (TW)

(73) Assignee: Allen & Thomas Cosmetic Accessories Co., Ltd., Zhuhai (CN)

( * ) Notice: Subject to any disclaimer, the term of this patent is extended or adjusted under 35 U.S.C. 154(b) by 474 days.

(21) Appl. No.: 12/604,493

(22) Filed: Oct. 23, 2009

(65) Prior Publication Data

US 2011/0095052 A1 Apr. 28, 2011

(51) Int. Cl.

| | |
|---|---|
| ***B65D 35/22*** | (2006.01) |
| ***B67D 7/06*** | (2010.01) |
| ***B67D 7/22*** | (2010.01) |
| *B67D 7/78* | (2010.01) |

(52) U.S. Cl. ..... 222/94; 222/144.5; 222/145.1; 222/145.4; 222/545; 222/546; 222/42

(58) Field of Classification Search ..... 222/41, 222/42, 46, 48, 94, 144.5, 145.1, 145.4, 145.5, 222/145.7, 145.8, 486, 489, 544–546
See application file for complete search history.

(56) References Cited

U.S. PATENT DOCUMENTS

| | | | | |
|---|---|---|---|---|
| 1,925,962 | A * | 9/1933 | Hoyer | 222/142.9 |
| 3,768,701 | A * | 10/1973 | Leas et al. | 222/129.4 |
| 3,814,287 | A * | 6/1974 | Darbon et al. | 222/94 |
| 3,850,346 | A * | 11/1974 | Richardson et al. | 222/145.7 |
| 3,876,111 | A * | 4/1975 | Swain | 222/94 |
| 4,585,149 | A * | 4/1986 | Zulauf | 222/94 |
| 4,771,919 | A * | 9/1988 | Ernst | 222/134 |
| 4,838,457 | A * | 6/1989 | Swahl et al. | 222/48 |
| 5,353,964 | A * | 10/1994 | Liu et al. | 222/134 |
| 6,997,353 | B2 * | 2/2006 | Decottignies et al. | 222/105 |
| 7,175,360 | B2 * | 2/2007 | Zhang | 401/186 |
| 7,287,927 | B2 * | 10/2007 | Zhang | 401/278 |
| 7,435,027 | B2 * | 10/2008 | Hetzel | 401/47 |
| 7,934,624 | B2 * | 5/2011 | Seelhofer | 222/129 |
| 7,988,377 | B2 * | 8/2011 | Zhang | 401/186 |
| 2001/0013523 | A1 * | 8/2001 | Gross et al. | 222/94 |
| 2003/0006247 | A1 * | 1/2003 | Olivier et al. | 222/83 |
| 2003/0089735 | A1 * | 5/2003 | Iwatsubo | 222/95 |
| 2005/0155979 | A1 * | 7/2005 | Lee et al. | 222/94 |
| 2009/0218241 | A1 * | 9/2009 | Sogaro | 206/219 |

* cited by examiner

*Primary Examiner* — Kevin P Shaver
*Assistant Examiner* — Nicholas Weiss

(57) ABSTRACT

A dispenser includes a flexible outer tube, a flexible inner tube in the outer tube, a plunger switch, a spring biased valve assembly having a rotation actuator, and a cap. After cap removal, a rotation of the rotation actuator enables an extrusion of a material in the outer tube out of the spout of the valve assembly via a material dispensation tunnel of the rotation actuator when the outer tube is depressed. A further rotation of the rotation actuator enables an extrusion of a material in the inner tube out of the spout of the valve assembly via the material dispensation tunnel when the outer tube is depressed. A still further rotation of the rotation actuator enables a mixed extrusion of the materials in both the inner and outer tubes out of the spout of the valve assembly via the material dispensation tunnel when the outer tube is depressed.

8 Claims, 9 Drawing Sheets

DISPENSER WITH TWO FLEXIBLE TUBES

BACKGROUND OF THE INVENTION

1. Field of Invention

The invention relates to lotion dispensers and applicators and more particularly to a dispenser having flexible inner and outer tubes for extruding first and/or second cosmetic materials (e.g., lotion) by rotating a rotation actuator on a spout.

2. Description of Related Art

A conventional lotion dispenser generally comprises a flexible inner tube 70, a flexible outer tube 80, a spout 90, and a cap (see FIGS. 8-9).

However, the well-known lotion dispenser suffers from several disadvantages. For example, it is not airtight. Lotion contained in the inner tube 70 may be extruded out of the spout 90 when the outer tube 80 is depressed. After use, lotion at the spout 90 may become dry to block the spout 90 or deteriorate the quality when it is exposed. This in turn can cause inconvenience in future use. Further, this is a waste. Thus, a need for improvement exists.

SUMMARY OF THE INVENTION

It is therefore one object of the invention to provide a dispenser comprising a flexible outer tube comprising a spout, external threads proximate to the spout, an annular protrusion between the external threads and the spout, an indicating mark proximate to one end of the external threads, and an internal space; a flexible inner tube disposed in the outer tube comprises an internal space, a front extension, a protuberance in the front extension, a passageway on a front edge of the front extension, and a channel member through the protuberance and being in communication with the space of the inner tube and a space in front of the inner tube; a plunger switch comprising a hollow cylindrical body, a shank projecting forward from a center of a front end of the cylindrical body, a molded key on a surface of the shank, two passages on a front edge of the cylindrical body, and two channel members on the front end of the cylindrical body proximate to the shank, wherein the channel members are in communication with an internal space defined by the cylindrical body and a space in front of the plunger switch, and the cylindrical body is fitted in the front extension of the inner tube; a valve assembly comprising a cylindrical rotation actuator including a stepped-diameter stem projecting from a front end, an inward extending rim on a rear end, an internal cylindrical member including a material dispensation tunnel through both the cylindrical member and the stem, an axial slot on an inner surface of the cylindrical member, and an indication unit on an outer surface of the rotation actuator; and a spout releasably secured onto the stem, wherein the key of the plunger switch slides in the slot so that both the plunger switch and the rotation actuator are capable of co-rotating; an elastic member put on the spout of the outer tube; and a cap comprising internal threads on an inner surface adjacent to a rear opening, and an engagement surface adjacent to the internal threads, wherein in a closed state of the dispenser the internal threads of the cap are secured to the external threads of the outer tube with the elastic member being biased between a blind end of the rotation actuator and the protrusion of the outer tube, and the material dispensation tunnel being blocked by the shank; and wherein in response to unfastening and removing the cap the elastic member expands to push the rotation actuator until the rim is stopped by the protrusion of the outer tube with the material dispensation tunnel being not blocked by the shank such that a rotation of the rotation actuator communicates one of the passages with the passageway so as to extrude a material contained in the outer tube out of the spout of the valve assembly via the passageway, one of the passages, and the material dispensation tunnel when the outer tube is depressed; a further rotation of the rotation actuator communicates one of the channels with the channel member so as to extrude a material contained in the inner tube out of the spout of the valve assembly via the channel member, one of the channels, and the material dispensation tunnel when the outer tube is depressed; and a still further rotation of the rotation actuator communicates both the other passage with the passageway and the other channel with the channel member so as to extrude the material in the outer tube out of the spout of the valve assembly via the passageway, the other passage, and the material dispensation tunnel and extrude the material in the inner tube out of the spout of the valve assembly via the channel member, the other channel, and the material dispensation tunnel respectively when the outer tube is depressed with the materials of both the inner and outer tubes being mixed in the material dispensation tunnel.

The invention has the following advantages. After removing the cap, a rotation of the spring biased rotation actuator in cooperation with the plunger switch enables an extrusion of a viscous first cosmetic material in the outer tube and/or a viscous second cosmetic material in the inner tube out of the spout of the valve assembly via the material dispensation tunnel of the rotation actuator when the outer tube is depressed. Further, the first and second cosmetic materials can be either the same materials but having different colors or different materials so as to obtain an aesthetic mixture of the first and second cosmetic materials. Furthermore, an airtightness of the closed lotion dispenser can be achieved when the cap is threadedly secured onto the outer tube. Hence, after use, the material left at the material dispensation tunnel can be prevented from becoming dry to block the tunnel or deteriorate the quality.

The above and other objects, features and advantages of the invention will become apparent from the following detailed description taken with the accompanying drawings.

DETAILED DESCRIPTION OF THE INVENTION

Figure 1:
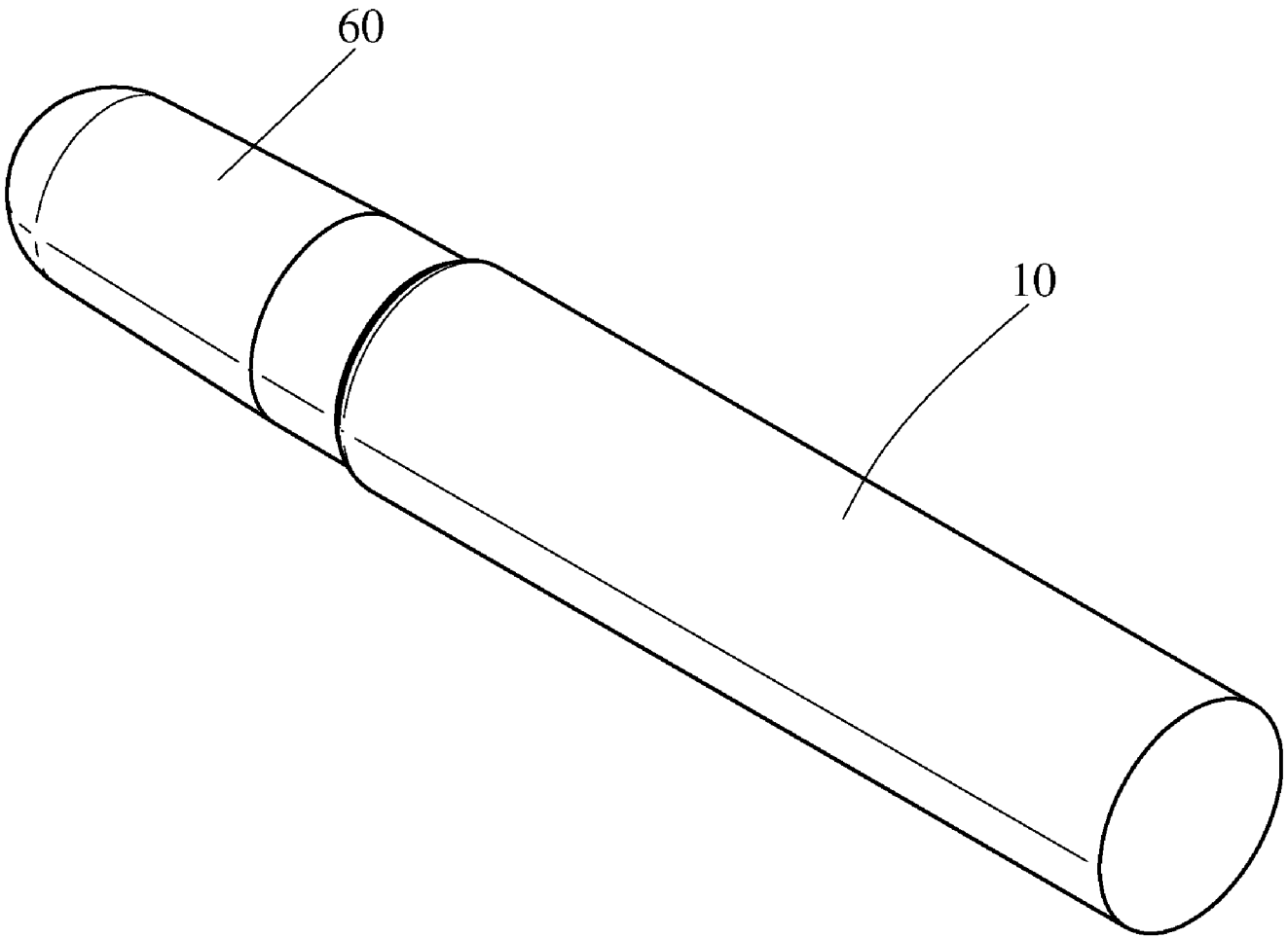
FIG. 1 is a perspective view of a preferred embodiment of the lotion dispenser according to the invention.
Figure 2:
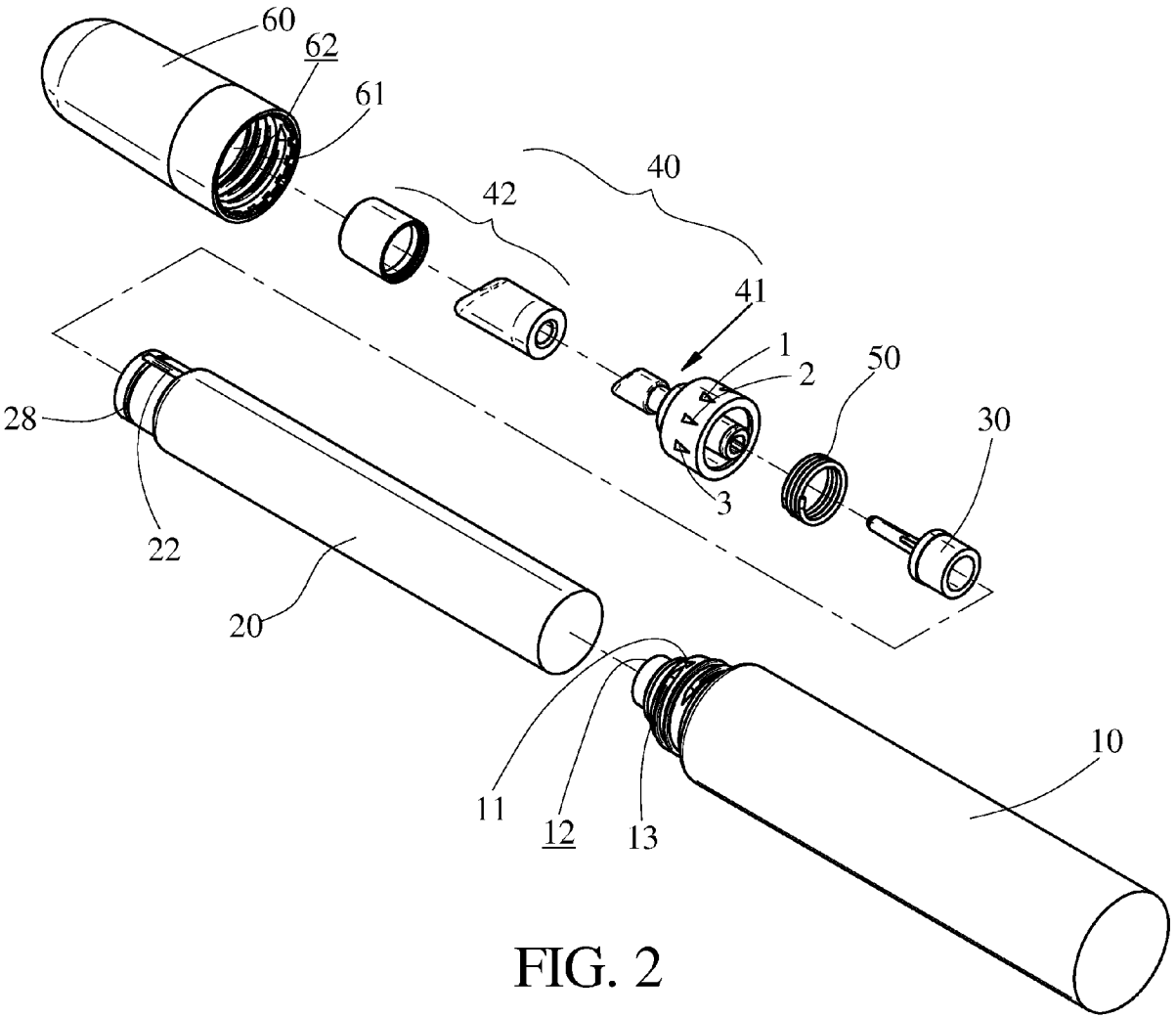
FIG. 2 is an exploded view of the lotion dispenser of FIG. 1.
Figure 3:
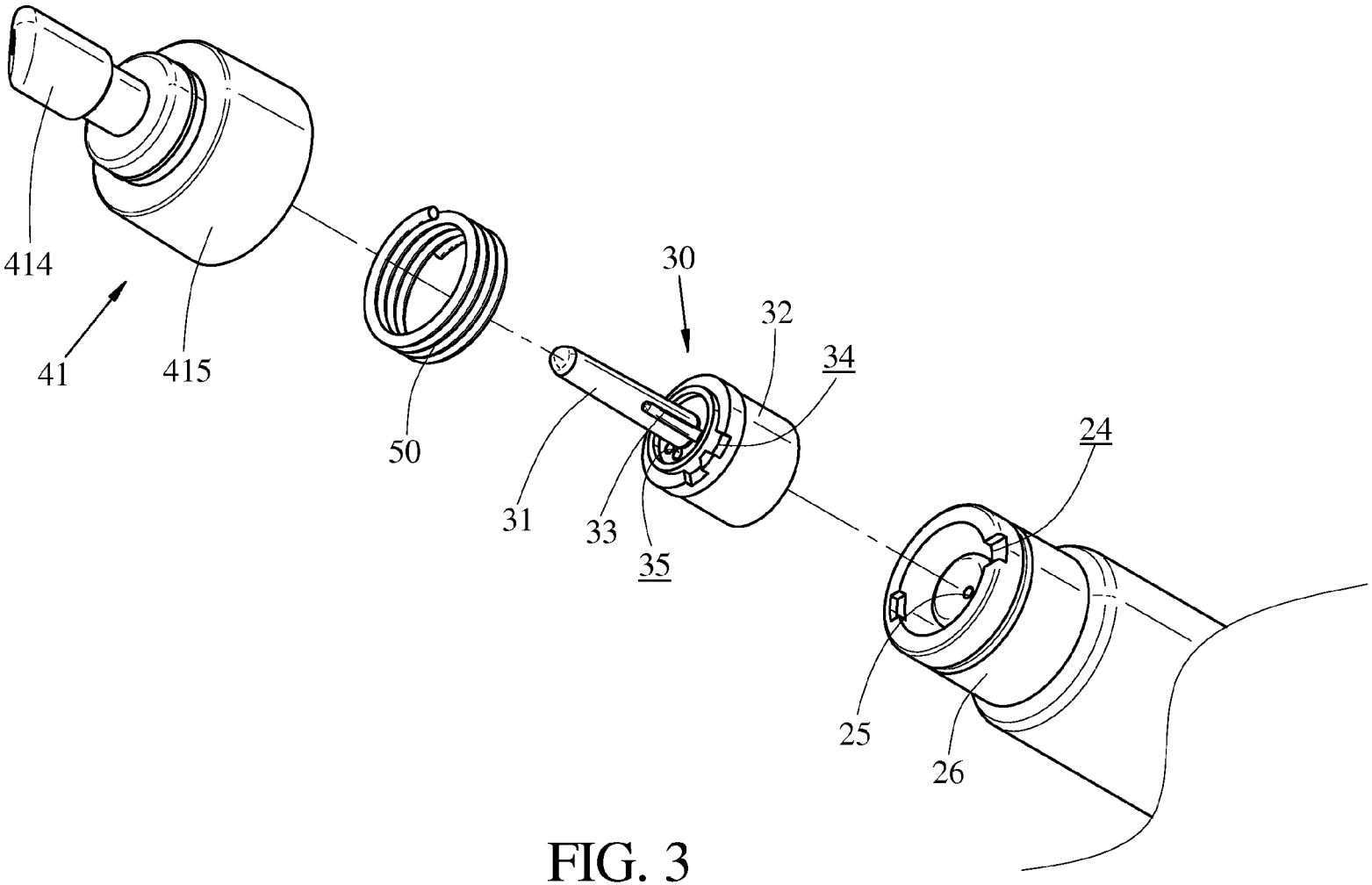
FIG. 3 is another view of some components of the lotion dispenser of FIG. 2.
Figure 4:
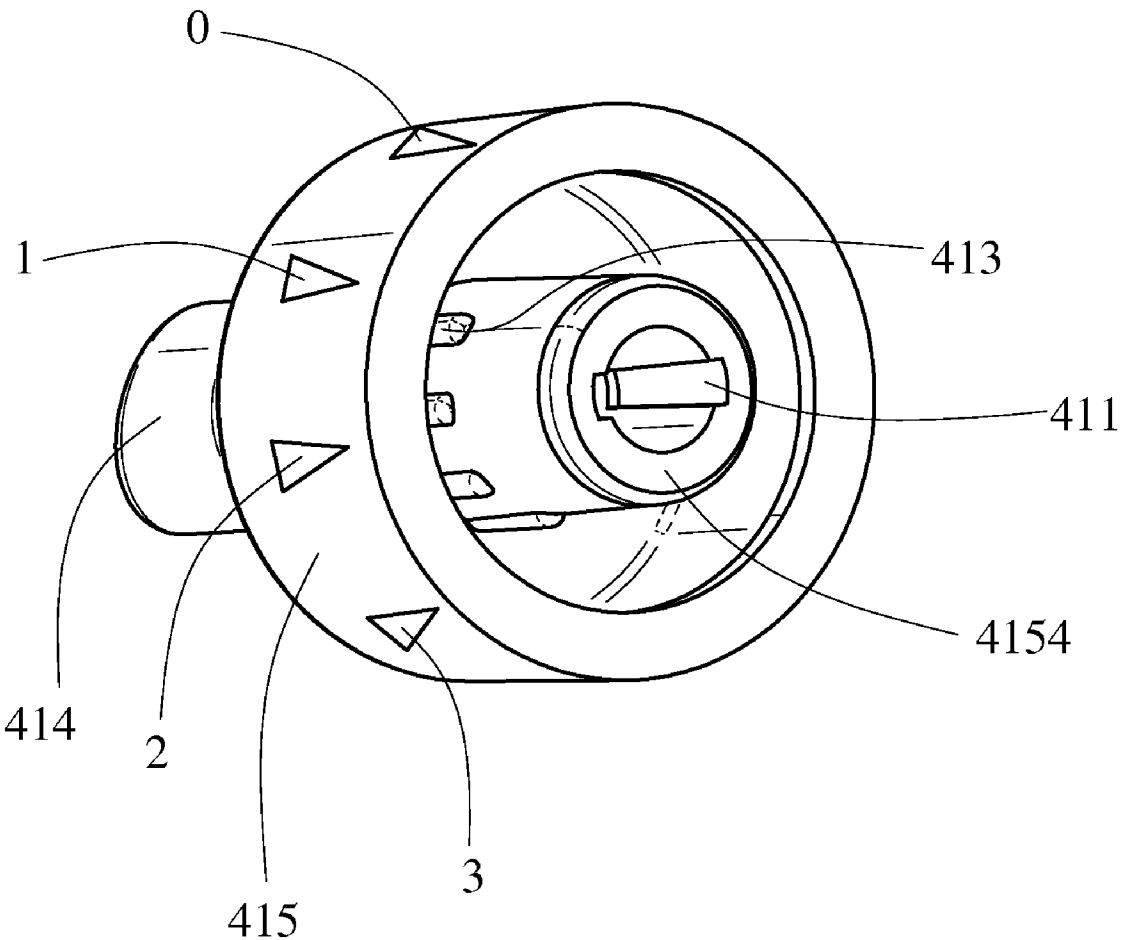
FIG. 4 is a perspective view of the rotation actuator of FIG. 2.
Figure 5:
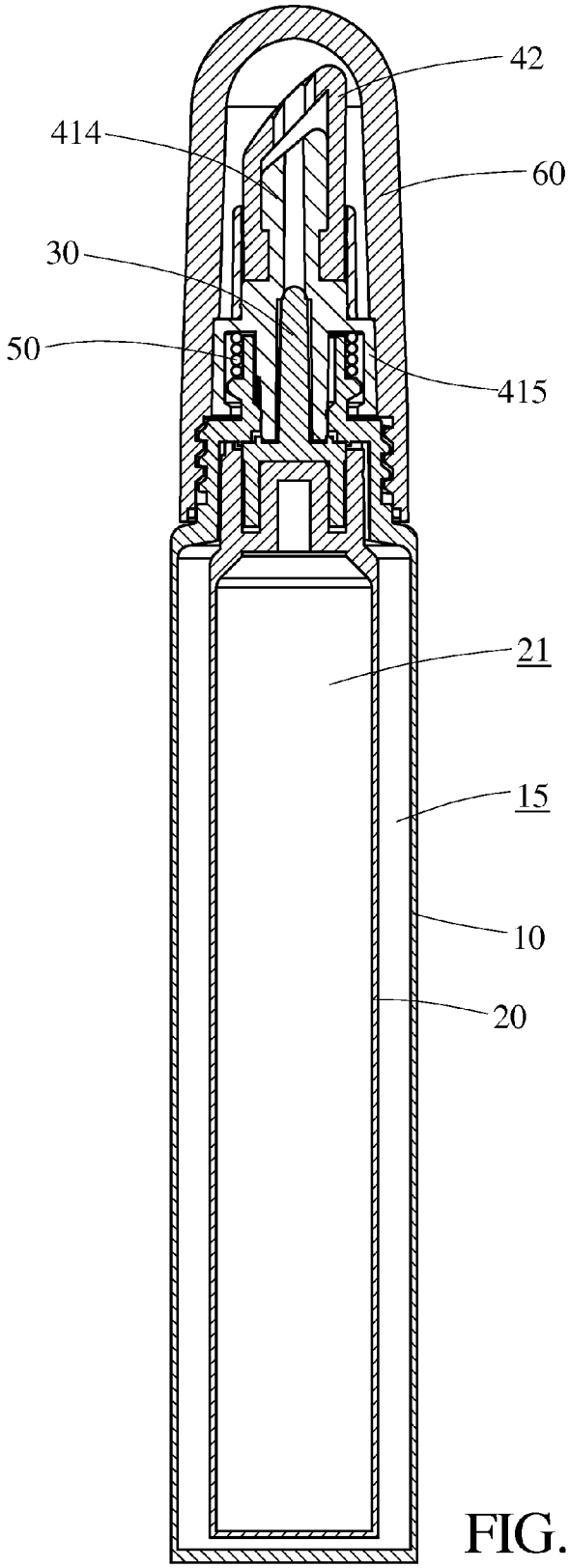
FIG. 5 is a longitudinal sectional view of the lotion dispenser shown in FIG. 1.

Referring to FIGS. 1 to 6, a lotion dispenser in accordance with a preferred embodiment of the invention comprises a flexible outer tube 10, a flexible inner tube 20, a plunger switch 30, a valve assembly 40, an elastic member 50, and a cap 60. Each of the above components will now be described in detail below.

The outer tube 10 comprises a spout 12, external threads 13 proximate to the spout 12, an annular protrusion 14 between the external threads 13 and the spout 12, an indicating mark 11 disposed from one end of the external threads 13, and an internal space 15.

The inner tube 20 is mounted within the outer tube 10 and comprises a front extension 26 having an internal hollow protrusion 27, an internal space 21, an annular groove 28 on an outer surface of the front extension 26 and being proximate to a front end of the front extension 26, a molded key 22 on the outer surface of the front extension 26 and crossing the groove 28, an annular protrusion 23 on an outer surface of the hollow protrusion 27, a passageway 24 on a front edge of the front extension 26, and an inclined channel member 25 communicating with the space 21 and a space in front of the inner tube 20.

The plunger switch 30 comprises a hollow cylindrical body 32 having an annular groove (not numbered) on an inner surface being matingly engaged with the annular protrusion 23, a shank 31 projecting forward from a center of a front end of the cylindrical body 32, a molded key 33 on an outer surface of the shank 31, two adjacent passages 34 on a front edge of the cylindrical body 32, and two adjacent channels 35 proximate to the bottom of the shank 31 and being in communication with an internal space defined by the cylindrical body 32 and a space in front of the plunger switch 30. The cylindrical body 32 is mounted into the front extension 26 to seat upon the internal hollow protrusion 27.

The valve assembly 40 comprises a rotation actuator 41 and a spout 42. Alternatively, the spout 42 is shaped as the head of a lipstick or lip brush in other embodiments. The rotation actuator 41 comprises a hollow cylinder 415 including an inward extending rim 4156 on a rear end and an internal hollow cylindrical member 4154 with the shank 31 slidably disposed therein, an axial slot 411 on an inner surface of the cylindrical member 4154, a plurality of molded keys 413 on an outer surface of the cylindrical member 4154, triangular first, second, third, and fourth indication marks 0, 1, 2, and 3 equally spaced around an outer surface of the cylinder 415, a hollow stepped-diameter stem 414 projecting from a front end of the cylinder 415, and an axial material dispensation tunnel 416 through the cylindrical member 4154 and the stem 414.

The spout 42 is releasably secured onto the stem 414. The valve assembly 40 is assembled with the plunger switch 30 with the key 33 slidably disposed in the slot 411. As a result, the valve assembly 40 (i.e., the rotation actuator 41) can co-rotate with the plunger switch 30.

The elastic member 50 is put on the spout 12 and biased between a blind end of the cylinder 415 and the protrusion 14. The bullet-shaped cap 60 comprises internal threads 61 on an inner surface adjacent to a rear opening 62, and an engagement surface 63 adjacent to the internal threads 61 within the cap 60.

In a closed state of the lotion dispenser the internal threads 61 are secured to the external threads 13 with the elastic member 50 being biased between the blind end of the cylinder 415 and the protrusion 14 and the material dispensation tunnel 416 being blocked by the shank 31.

Figure 6:
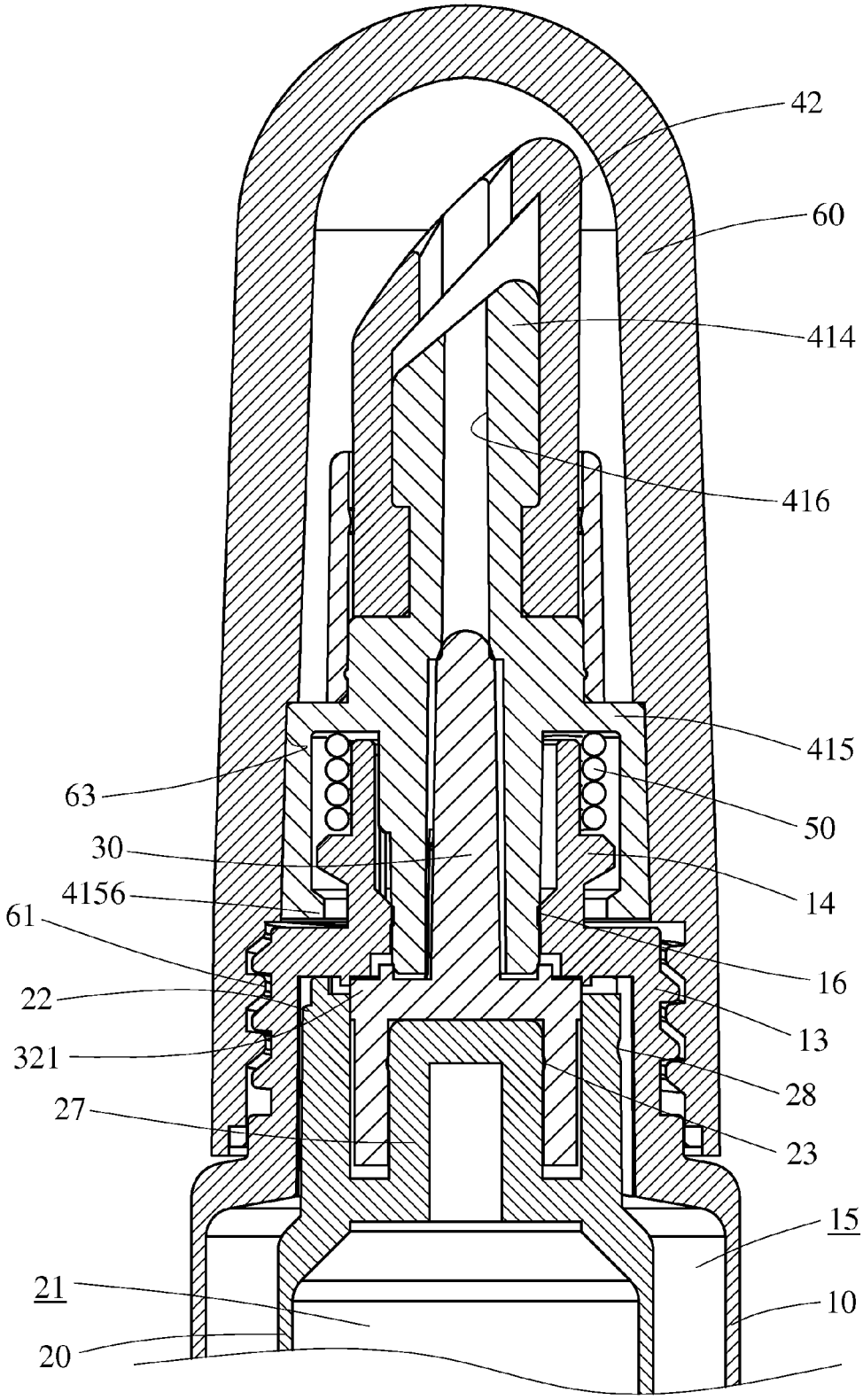
FIG. 6 is an enlarged view of the front portion of FIG. 5.

In a first step of use a person may unfasten the cap 60 and remove the same. As a result, the elastic member 50 expands to push the rotation actuator 41 forward (i.e., upward as seen in FIG. 6) until the rim 4156 is stopped by the protrusion 14. Also, the material dispensation tunnel 416 is not blocked by the shank 31.

Thereafter, the person may rotate the rotation actuator 41 to communicate one of the passages 34 with the passageway 24. Thus, a material in the outer tube 10 may be extruded out of the spout 42 via the passageway 24, one of the passages 34, and the material dispensation tunnel 416 when the lotion dispenser is depressed. In this position, all other material dispensation paths are blocked. Alternatively, a further rotation of the rotation actuator 41 can communicate one of the channels 35 with the channel member 25. Thus, a material in the inner tube 20 may be extruded out of the spout 42 via the channel member 25, one of the channels 35, and the material dispensation tunnel 416 when the lotion dispenser is depressed. In this position, all other material dispensation paths are blocked. Still alternatively, a still further rotation of the rotation actuator 41 can communicate both the other passage 34 with the passageway 24 and the other channel 35 with the channel member 25. Thus, the material in the outer tube 10 may be extruded out of the spout 42 via the passageway 24, the other passage 34, and the material dispensation tunnel 416 and the material in the inner tube 20 may be extruded out of the spout 42 via the channel member 25, the other channel 35, and the material dispensation tunnel 416 respectively when the lotion dispenser is depressed. In this position, the materials of both the inner and outer tubes 20 and 10 are mixed in the material dispensation tunnel 416 prior to dispensing.

Another detailed description of the above paragraph is as below. A first rotation of the rotation actuator 41 may point the indicating mark 11 at the first indication mark 0. In this position, both the inner and outer tubes 20 and 10 are blocked by the plunger switch 30. A second rotation of the rotation actuator 41 may point the indicating mark 11 at the second indication mark 1. In this position, the material in the outer tube 10 can communicate with both the plunger switch 30 and the valve assembly 40 for dispensation and the inner tube 20 is blocked by the plunger switch 30. A third rotation of the rotation actuator 41 may point the indicating mark 11 at the third indication mark 2. In this position, the materials in both the inner and outer tubes 20 and 10 can communicate with both the plunger switch 30 and the valve assembly 40 for dispensation. A fourth rotation of the rotation actuator 41 may point the indicating mark 11 at the third indication mark 3. In this position, the material in the inner tube 20 can communicate with both the plunger switch 30 and the valve assembly 40 for dispensation and the outer tube 10 is blocked by the plunger switch 30.

Portions of the cylinder 415 and the engagement surface 63 are matingly tightly engaged together when the cap 60 is threadedly secured to the outer tube 10. As a result, an airtight-ness of the closed lotion dispenser is achieved. To the contrary, an unfastening of the cap 60 can cause the shank 31 to unblock the material dispensation tunnel 416 due to the expansion of the elastic member 50.

Preferably, the elastic member 50 is a torsion spring or the like.

Preferably, a viscous first cosmetic material is contained in the space 15.

Preferably, a viscous second cosmetic material is contained in the space 21. The first and second cosmetic materials can be either the same materials but having different colors or different materials. It is contemplated by the invention that the first cosmetic material and/or the second cosmetic material can be dispensed when the lotion dispenser is depressed. Thus, the ways of the dispensation of the invention can be varied according to a user's preference. Further, an aesthetic mixture of the first and second cosmetic materials can be obtained. Furthermore, an airtight-ness of the closed lotion dispenser can be achieved.

Preferably, the outer tube 10 further comprises an annular flange 16 on an stepped-diameter inner surface of the spout 12—so as to enhance the airtight-ness of the closed lotion dispenser.

Preferably, the cylindrical body 32 has an annular flange 321 on one end surface engaged with a rear portion of the outer surface of the cylindrical member 4154 so as to further enhance the airtight-ness of the closed lotion dispenser.

Figure 7:
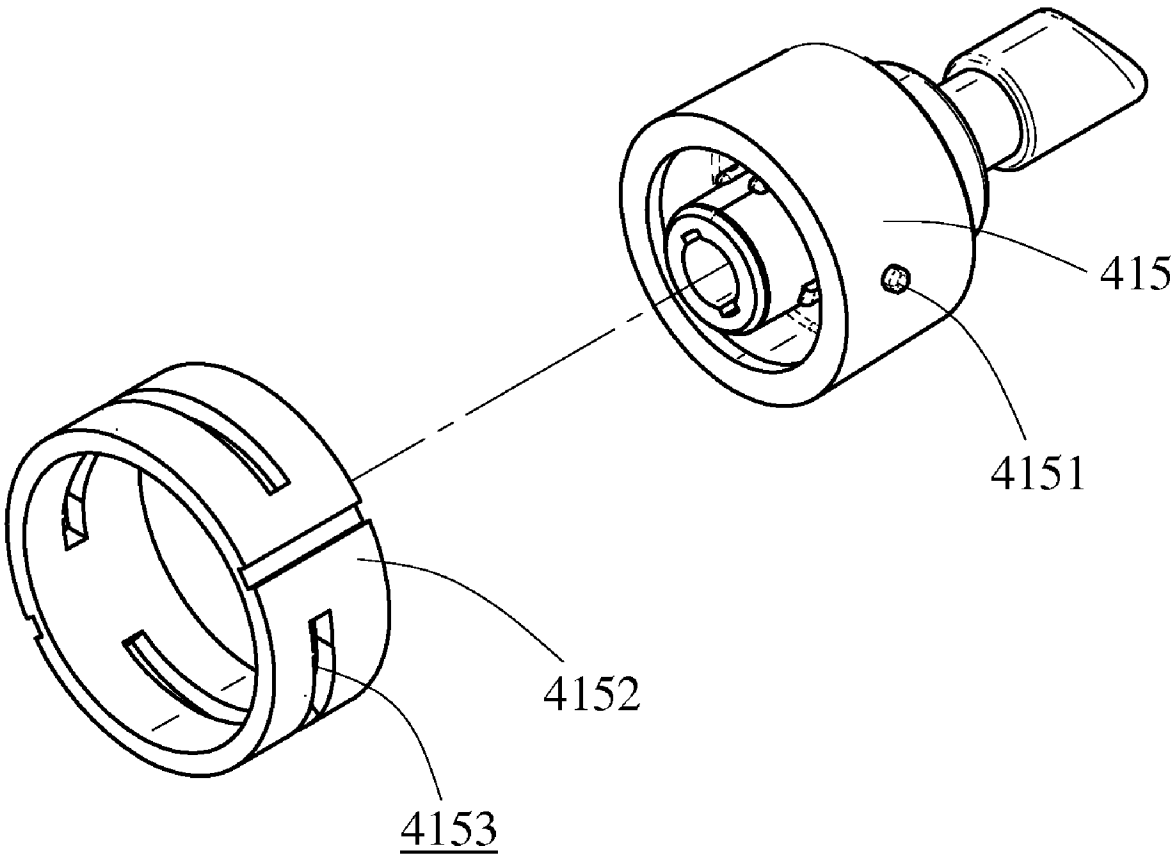
FIG. 7 is an exploded view of another preferred embodiment of the valve assembly according to the invention.
Figure 8:
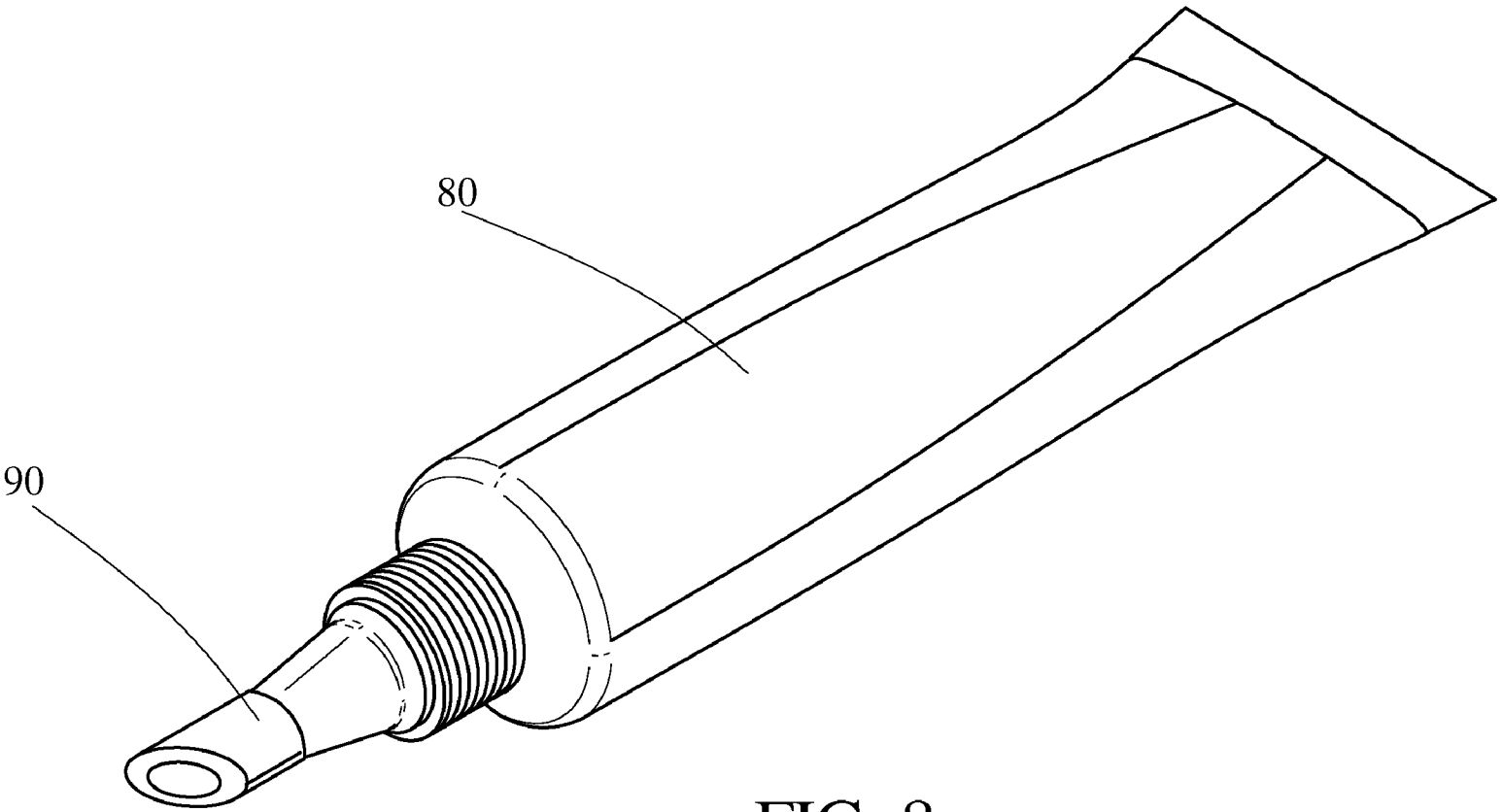
FIG. 8 PRIOR ART
FIG. 8 is a perspective view of a conventional lotion dispenser having two flexible tubes.
Figure 9:
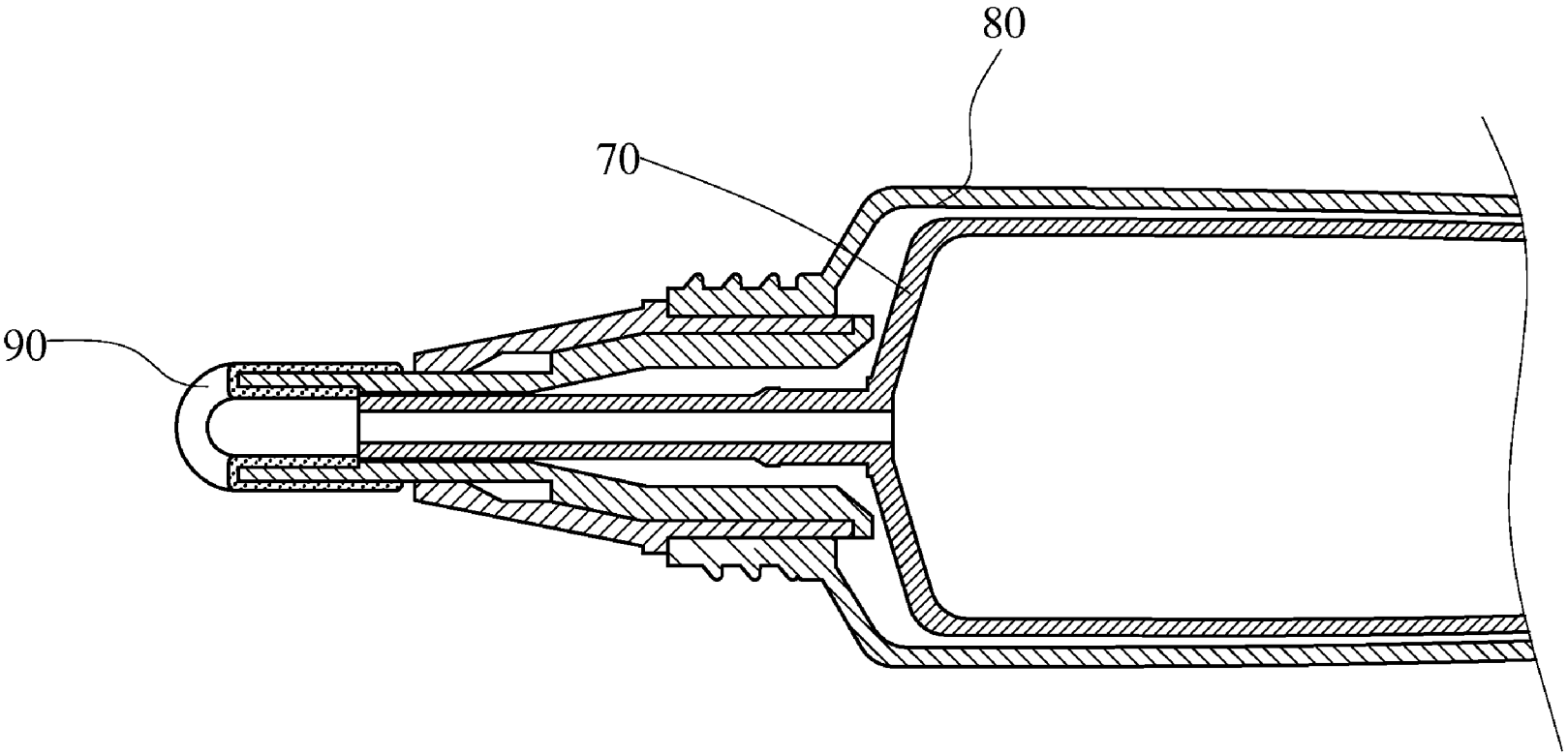
FIG. 9 PRIOR ART
FIG. 9 is a longitudinal sectional view of the front portion of the lotion dispenser shown in FIG. 8.

Referring to FIG. 7, another preferred embodiment of the valve assembly according to the invention is shown. The characteristics of another preferred embodiment of the valve assembly are detailed below. The first, second, third, and fourth indication marks are eliminated. The rotation actuator comprises a ring 4152 having two opposite elongated apertures 4153 on a surface. Two opposite pegs 4151 are formed on an outer surface of the cylinder 415. The pegs 4151 are disposed in the elongated apertures 4153 and can slide therein when the ring 4152 is mounted on the cylinder 415. The ring 4152 is concealed by the cap 60 when the lotion dispenser is closed. A rotation of the ring 4152 by sliding the pegs 4151 in the elongated apertures 4153 can dispense the first cosmetic material and/or the second cosmetic material.

While the invention herein disclosed has been described by means of specific embodiments, numerous modifications and variations could be made thereto by those skilled in the art without departing from the scope and spirit of the invention set forth in the claims.

What is claimed is:

1. A dispenser comprising:

a flexible outer tube comprising a spout, external threads proximate to the spout, an annular protrusion between the external threads and the spout, an indicating mark proximate to one end of the external threads, and an internal space;

a flexible inner tube disposed in the outer tube and comprising an inner space, a front extension, a protuberance in the front extension, a passageway on a front edge of the front extension, and a channel member through the protuberance and being in communication with the inner space of the inner tube and a space in front of the inner tube;

a plunger switch comprising a hollow cylindrical body, a shank projecting forward from a center of a front end of the cylindrical body, a molded key on a surface of the shank, two passages on a front edge of the cylindrical body, and two channel members on the front end of the cylindrical body proximate to the shank wherein the channel members are in communication with an internal space defined by the cylindrical body and a space in front of the plunger switch, and the cylindrical body is fitted in the front extension of the inner tube;

a valve assembly comprising a cylindrical rotation actuator including a stepped-diameter stem projecting from a front end, an inward extending rim on a rear end, an internal cylindrical member including a material dispensation tunnel through both the cylindrical member and the stem, an axial slot on an inner surface of the cylindrical member, and an indication unit on an outer surface of the rotation actuator; and a spout releasably secured onto the stem wherein the key of the plunger switch slides in the slot so that both the plunger switch and the rotation actuator are capable of co-rotating;

an elastic member put on the spout of the outer tube; and a cap comprising internal threads on an inner surface adjacent to a rear opening, and an engagement surface adjacent to the internal threads, wherein in a closed state of the dispenser the internal threads of the cap are secured to the external threads of the outer tube with the elastic member being biased between a blind end of the rotation actuator and the protrusion of the outer tube, and the material dispensation tunnel being blocked by the shank; and wherein in response to unfastening and removing the cap the elastic member expands to push the rotation actuator until the rim is stopped by the protrusion of the outer tube with the material dispensation tunnel being not blocked by the shank such that:

a rotation of the rotation actuator communicates one of the passages with the passageway so as to extrude a material contained in the outer tube out of the spout of the valve assembly via the passageway, one of the passages, and the material dispensation tunnel when the outer tube is depressed;

a further rotation of the rotation actuator communicates one of the channels with the channel member so as to extrude a material contained in the inner tube out of the spout of the valve assembly via the channel member, one of the channels, and the material dispensation tunnel when the outer tube is depressed; and a still further rotation of the rotation actuator communicates both the other passage with the passageway and the other channel with the channel member so as to extrude the material in the outer tube out of the spout of the valve assembly via the passageway, the other passage, and the material dispensation tunnel and extrude the material in the inner tube out of the spout of the valve assembly via the channel member, the other channel, and the material dispensation tunnel respectively when the outer tube is depressed with the materials of both the inner and outer tubes being mixed in the material dispensation tunnel.

2. The dispenser of claim 1, wherein the indication unit comprises first, second, third, and fourth indication marks; and wherein a first rotation of the rotation actuator points the indicating mark at the first indication mark with both the inner and outer tubes being blocked by the plunger switch, a second rotation of the rotation actuator points the indicating mark at the second indication mark with the material in the outer tube communicating with both the plunger switch and the valve assembly for dispensation and the inner tube being blocked by the plunger switch, a third rotation of the rotation actuator points the indicating mark at the third indication mark with the materials in both the inner and outer tubes communicating with both the plunger switch and the valve assembly for dispensation, and a fourth rotation of the rotation actuator points the indicating mark at the third indication mark with the material in the inner tube communicating with both the plunger switch and the valve assembly for dispensation and the outer tube being blocked by the plunger switch.

3. The dispenser of claim 1, wherein the elastic member is a torsion spring.

4. The dispenser of claim 1, wherein the material in the inner space of the outer tube is a viscous first cosmetic material.

5. The dispenser of claim 1, wherein the material in the inner space of the inner tube is a viscous second cosmetic material.

6. The dispenser of claim 1, wherein the outer tube further comprises an annular flange on a stepped-diameter inner surface of the spout.

7. The dispenser of claim 1, wherein the cylindrical body of the plunger switch comprises an annular flange on an end surface adapted to engage with a rear end of the material dispensation tunnel.

8. The dispenser of claim 1, wherein the valve assembly further comprises a ring having two opposite elongated apertures on a surface, and wherein the rotation actuator further comprises two opposite pegs on an outer surface, the pegs being slidably disposed in the elongated apertures when the ring is mounted on the rotation actuator so as to cause the dispensation by rotating the ring with the pegs sliding in the elongated apertures.

* * * * *